United States Patent [19]

Griesheimer et al.

[11] 4,353,335

[45] Oct. 12, 1982

[54] HAND STARTING MECHANISM FOR AN INTERNAL COMBUSTION ENGINE

[75] Inventors: Willi Griesheimer; Eduard Kukulak, both of Lampertheim, Fed. Rep. of Germany

[73] Assignee: Farymann Diesel GmbH, Lampertheim, Fed. Rep. of Germany

[21] Appl. No.: 240,462

[22] Filed: Mar. 4, 1981

[30] Foreign Application Priority Data

Mar. 20, 1980 [DE] Fed. Rep. of Germany ..... 3010727

[51] Int. Cl.[3] ..... F02N 1/00

[52] U.S. Cl. ..... 123/185 P; 123/185 G; 123/185 S; 74/6

[58] Field of Search ..... 123/185 S, 185 P, 185 G, 123/179 C; 74/6

[56] References Cited

U.S. PATENT DOCUMENTS

| | | | |
|---|---|---|---|
| 800,290 | 9/1905 | Grace | 123/185 S |
| 1,923,037 | 8/1933 | Marcus | 123/185 G |
| 2,187,545 | 1/1940 | Lansing | 123/185 G |
| 2,933,077 | 4/1960 | Ruth | 123/185 S |
| 3,646,820 | 3/1972 | Vogel et al. | 74/6 |

FOREIGN PATENT DOCUMENTS

| | | | |
|---|---|---|---|
| 2916724 | 4/1979 | Fed. Rep. of Germany | 123/185 S |

*Primary Examiner*—P. S. Lall

*Attorney, Agent, or Firm*—Andrus, Sceales, Starke & Sawall

[57] ABSTRACT

A hand starting mechanism for an internal combustion engine includes an axially displaceable starting shaft. The starting shaft has a one way dog coupling which couples the starting shaft to the shaft to be cranked during the starting procedure but which disengages these shafts when the engine starts running. The starting shaft also includes an outer entrainment pin which engages a claw-like frontal recess in the inner rotary part of a freewheel device during the starting procedure. Upon engine kickback, the outer entrainment pin slides over one or more ramps in the frontal recess moving the starting shaft in an axially outward direction to disengage the one way dog coupling.

5 Claims, 7 Drawing Figures

HAND STARTING MECHANISM FOR AN INTERNAL COMBUSTION ENGINE

BACKGROUND OF THE INVENTION

This invention relates to a hand-starting mechanism for an internal combustion engine.

Present safety regulations for hand-starting mechanisms require a safety device against kickback of the starting handle. Kickback occurs when the internal combustion engine does not overcome the upper dead center when firing thus generating a movement opposite to its normal sense of rotation. Due to this opposite movement the engine operator receives a blow on his hand and arm which may cause painful injuries. In order to prevent this danger anti-kickback devices are used consisting of a freewheel device which prevents the kickback movement and permits the starting movement. For example in the starting mechanism according to British Pat. No. 1 562 677 the starting shaft is rigidly connected with the inner rotary part of the freewheel device. This has the disadvantage that the freewheel device has to support the full force of the kickback. In the starting mechanism according to British Pat. No. 1 562 677 the starting handle is connected with the starting shaft via a yieldabe entrainment device in order to avoid the abrupt stopping of the cranking movement by the blocked freewheel device.

SUMMARY OF THE INVENTION

An object of the invention is to avoid the aforementioned disadvantage and also the expense for the yieldable entrainment device.

By means of the present design throw-off claws of a one way dog coupling are separated from the entrainment pin of the shaft to be cranked after a very small travel of the shaft in the kickback direction during which the freewheel device has only to support the very small frictional force which occurs when the outer entrainment pin slides over the frontal ramps of the inner rotary part of the freewheel device. This very small kickback movement of the starting shaft cannot be felt at the handle and the cranking movement will not be stopped abruptly due to the nearly instantaneous separation of the starting shaft from the shaft to be cranked.

Advantageously a pushing out of the starting shaft together with the starting handle when the internal combustion engine fires or kicks back is avoided by providing the starting shaft on its outer circumference with two circumferential grooves into each of which can snap an axially immovable spring loaded locking pin, the locking pin being in the outer groove when the one way dog coupling is engaged and being in the inner groove when the one way dog coupling is disengaged.

The introduction of the starting shaft and handle during the starting procedure is facilitated advantageously by providing the starting shaft with threaded portions between the outer circumferential groove and the inner frontal face of the starting shaft into which the spring loaded locking pin is engageable so that the starting shaft is screwed axially in inward direction on the threaded portions when turned in the starting sense until the one way dog coupling becomes engaged.

Advantageously the separation of the claws of the one way coupling from the entrainment pin of the shaft to be cranked is facilitated by the claws being provided with entrainment faces extending parallel to the axis of the starting shaft in the vicinity of its inner frontal face.

The same advantageous purpose is served by a design according to which the entrainment pin of the shaft to be cranked is rounded off at its side facing the starting shaft.

DESCRIPTION OF THE DRAWINGS

An example of the starting mechanism according to the invention is shown in the drawings.

FIGS. 1, 2, 3 and 4 are drawn in a scale 2:1. FIGS. 5, 6 and 7 are drawn in a scale 1:1.

As shown in FIGS. 1 and 2 the starting handle 1 is fastened rigidly with the aid of the welding seam 2 to the outer frontal face 3 of the starting shaft 4. At the inner frontal face 5 of the starting shaft 4 are formed the two starting claws 6 with their inclined throw-off faces 7 (FIG. 3) and their entrainment faces 8. The latter are arranged parallel to the axis of the starting shaft 4. The faces 7 and 8 of the starting claws 6 form an one way dog coupling together with the entrainment pin 9. The entrainment pin 9 is fastened rigidly to the shaft 10 to be cranked belonging to the internal combustion engine of which only the housing portion 11 is visible. The shaft 10 is, in the example shown in FIGS. 1 and 2, the camshaft of a four-stroke internal combustion engine. The shaft 10 is supported by the ball bearing 12 and sealed by the lip seal 13. The entrainment pin 9 is rounded off at its side 14 (FIG. 2) facing the starting shaft 4. In the position shown in FIG. 1 the locking pin 16 which is loaded by the spring 15 has snapped into the outer circumferential groove 17 of the starting shaft 4, the one way dog coupling 6, 7, 8, 9 being engaged. In the position of the starting shaft 4 shown in FIG. 2 the locking pin 16 has snapped into the inner circumferential groove 18 of the starting shaft 4. The starting shaft 4 is provided with threaded portions 19 which form parts of a double helical thread. The starting shaft 4 has an outer entrainment pin 20 which engages during the starting procedure, i.e. in the position shown in FIG. 1, two claw-like frontal recesses 21 on the inner rotary part 22 of a freewheel device consisting of the part 22, the clamping elements 23 (FIG. 4), and the outer ring 24. The latter is connected rigidly with the housing 11. The recesses 21 are continuing into the frontal ramps 25 and 26 (FIGS. 5,6,7) of the inner rotary part 22. The freewheel device 22,23,24 is closed at its outer side by the cover plate 27 rolled over the outer ring 24. The rubber rings 28 and 29 are sealing the faces which are in relative movement.

DESCRIPTION OF THE ILLUSTRATED EMBODIMENT

Figure 1:
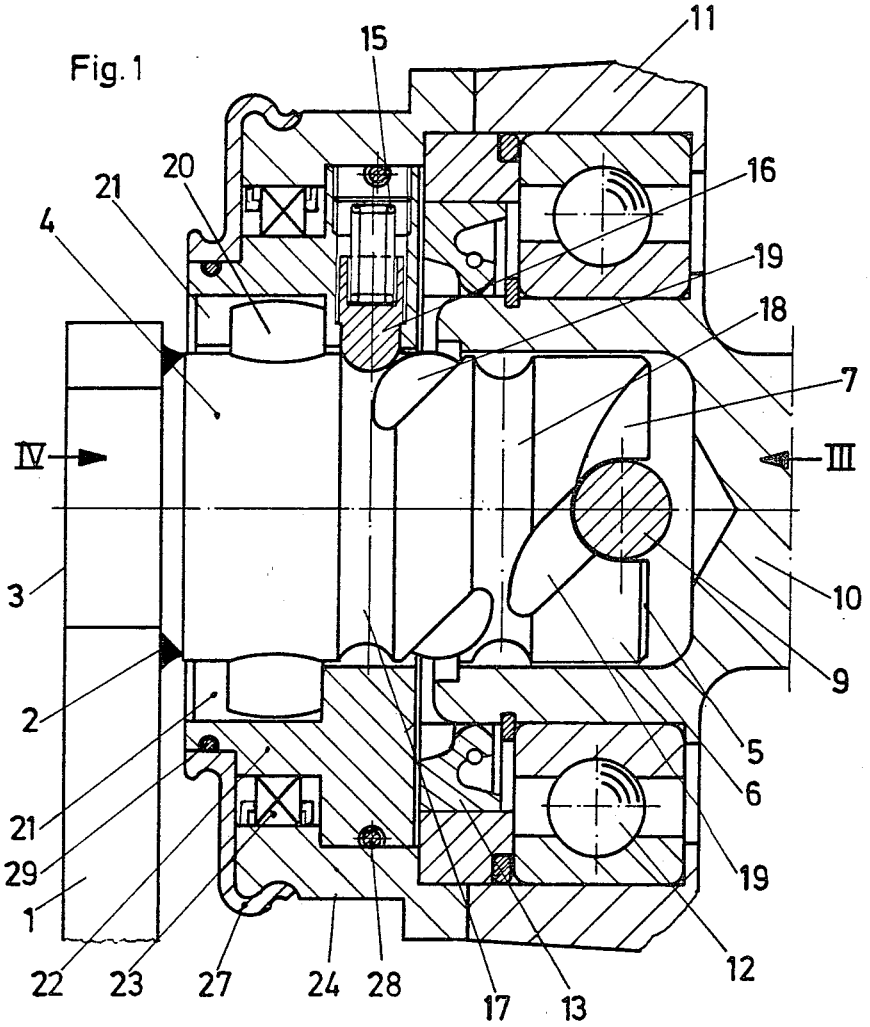
FIG. 1 is a longitudinal section of the mechanism with engaged dog coupling.
Figure 3:
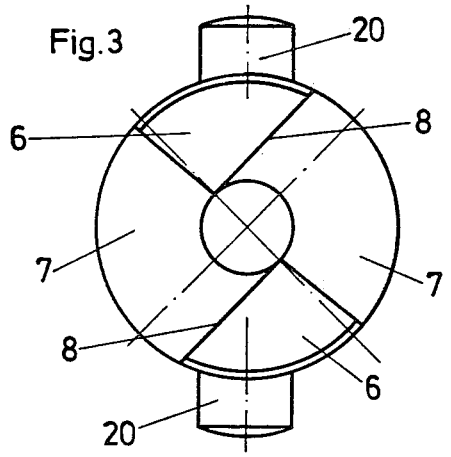
FIG. 3 is a view of the throw-off claws at the inner frontal face of the starting shaft seen in the direction of the arrow III.
Figure 4:
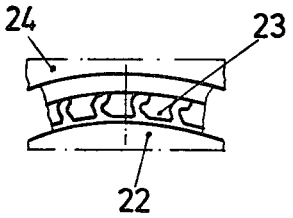
FIG. 4 is a cutout of a frontal view of the freewheel device seen in the direction of the arrow IV.
Figure 2:
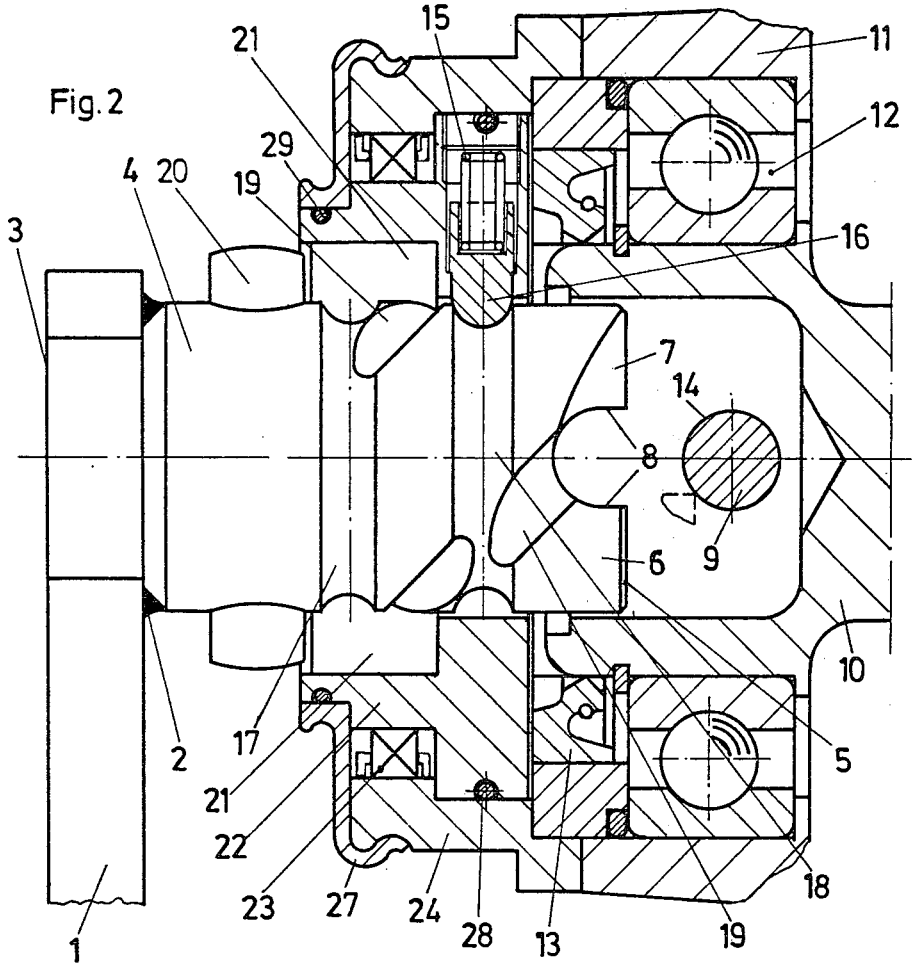
FIG. 2 is a longitudinal section of the mechanism with disengaged dog coupling.
Figure 7:
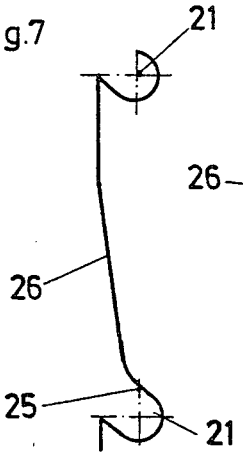
FIG. 7 is a development of the profile of the frontal recesses and ramps of the inner rotary part.
Figure 5:
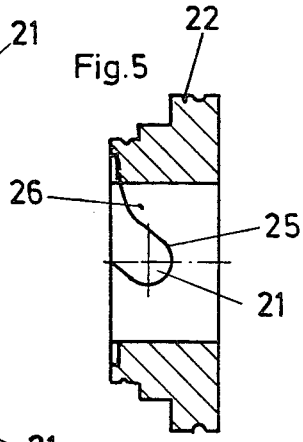
FIG. 5 is a longitudinal section along the line V—V in FIG. 6 of the inner rotary part of the freewheel device.
Figure 6:
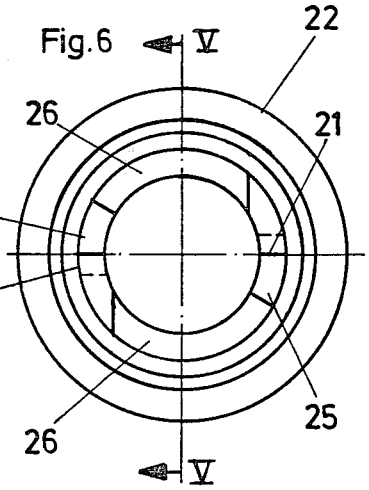
FIG. 6 is a front view of the inner rotary part shown in FIG. 5 seen in the direction of the arrow VI.

The function of the described hand-starting mechanism is the following:

For starting the starting shaft 4 is put axially into the mechanism with the aid of the starting handle 1 until the locking pin 16 snaps into the circumferential groove 18. Then the shaft 4 is in the position shown in FIG. 2. Now the starting handle 1 is turned in the starting sense (In the view of FIGS. 4 and 6 counterclockwise). Since the rubber rings 28 and 29 have a certain frictional effect the inner rotary part 22 remains stationary so that the starting shaft 4 is screwed in inward direction on the threaded portions 19 which are in contact with the locking pin 16. During this movement the entrainment pin 20 slides either along the ramps 25,26 or will be drawn directly into the recesses 21 if its position permits it. Thereupon the inner part 22 rotates in relation to the outer ring 24 which movement is permitted by the clamping elements 23. During this movement the entrainment pin 9 slides along the throw-off faces 7 until it stops at the entrainment faces 8 (FIG. 1) As a consequence the shaft 10 is entrained with the movement of the starting shaft 4 and the internal combustion engine is cranked. If the engine starts running regularly the entrainment pin 9 moves away clockwise (view of FIG. 3) from the entrainment faces 8 and slides over the throw-off faces 7 pushing the shaft 4 in outward direction which causes the locking pin 16 to jump out of the groove 17 and to snap into the groove 18. If the internal combustion engine does not fire regularly but kicks back the entrainment faces 8 remain in contact with the entrainment pin 9 which turns the starting shaft counterclockwise (view of FIG. 3) by a small amount. This corresponds to a small movement of the entrainment pin 20 in clockwise direction (view of FIGS. 4 and 6) which causes the pin 20 to slide in outward direction on the ramps 25 until the edges of the entrainment faces 8 are in the position on the surface 14 shown in broken lines in FIG. 2. Thereupon the edges slide over the surface 14 of the entrainment pin 9 which causes the starting shaft 4 to move into the position shown in full lines in FIG. 2. During this movement the clamping elements 23 prevent a clockwise (view of FIG. 4) movement of the part 22 relative to the outer ring 24 so that the entrainment pin 20 can slide in outward direction on the ramps 25. Due to the smallness of this movement the engine operator is protected effectively against a blow on his hand and arm. The ensuing quick disengagement of the one way dog coupling causes an instantaneous free turnability of the starting handle in the starting sense.

We claim:

1. Hand-starting mechanism for internal combustion engines with an axially displaceable starting shaft, with a starting handle fastened to the outer side of said starting shaft, with an one way dog coupling arranged at the inner frontal face of said starting shaft which couples the starting shaft and the shaft to be cranked during the starting procedure but separates these shafts when the internal combustion engine starts running, characterized in that, the starting shaft (4) is provided with an outer entrainment pin (20) which engages during the starting procedure one or more claw-like frontal recesses (21) on the inner rotary part (22) of a freewheel device (22,23,24) carrying with it in the inner rotary part relative to the outer stationary ring (24) of the freewheel device, whereas during kickback of the internal combustion engine the outer entrainment pin slides over one or more frontal ramps (25,26) of the recesses (21) of the then stationary inner rotary part (22) moving the starting shaft (4) in outward direction so that the one way dog coupling becomes disengaged.

2. Hand-starting mechanism according to claim 1, characterized in that, the starting shaft (4) is provided with two circumferential grooves (17,18) on its circumference and that a spring loaded axially immovable locking pin (16) can snap into either of the circumferential grooves, the locking pin being in the outer circumferential groove (17) when the one way dog coupling (6,7,8,9) is engaged, the locking pin being in the inner circumferential groove (18) when the one way dog coupling is disengaged.

3. Hand-starting mechanism according to claim 2, characterized in that, the starting shaft (4) is provided with threaded portions (19) between the outer circumferential groove (17) and the inner frontal face (5) of the starting shaft, said spring loaded locking pin (16) being arranged to snap into the threaded portions so that the starting shaft is screwed on the threaded portions axially in inward direction when turned in the starting sense until the one way dog coupling (6,7,8,9) becomes engaged.

4. Hand-starting mechanism according to claim 1, characterized in that, the entrainment faces (8) of the throw-off claws (6,7) are parallel to the axis of the starting shaft (4) in the vicinity of its inner front face (5).

5. Hand-starting mechanism according to claim 4, characterized in that, the entrainment pin (9) connected to the shaft to be cranked (10) and cooperating with the throw-off claws (6,7) is rounded off at its side (14) facing the starting shaft (4).

* * * * *

UNITED STATES PATENT AND TRADEMARK OFFICE

CERTIFICATE OF CORRECTION

PATENT NO. : 4,353,335

DATED : October 12, 1982

INVENTOR(S) : WILLI GRIESHEIMER ET AL

It is certified that error appears in the above-identified patent and that said Letters Patent is hereby corrected as shown below:

Col. 2, After line 29, Insert ---Description of the Illustrated Embodiment---; Col. 3, Before Line 1, Delete "DESCRIPTION OF THE ILLUSTRATED EMBODIMENT"; Col. 4, CLAIM 1, Line 16, Cancel "in"; Col. 4, CLAIM 4, Line 47, Cancel "front" and substitute therefor ---frontal---.

Signed and Sealed this

*Eighth* Day of *February 1983*

[SEAL]

*Attest:*

GERALD J. MOSSINGHOFF

*Attesting Officer*

*Commissioner of Patents and Trademarks*